US009993985B2

(12) United States Patent
Beutler

(10) Patent No.: US 9,993,985 B2
(45) Date of Patent: Jun. 12, 2018

(54) METHOD FOR PRODUCING PACKAGING BLANKS FOR CONSUMER GOODS

(71) Applicant: PHILIP MORRIS PRODUCTS S.A., Neuchatel (CH)

(72) Inventor: Mathias Beutler, Vallon (CH)

(73) Assignee: Philip Morris Products S.A., Neuchatel (CH)

( * ) Notice: Subject to any disclaimer, the term of this patent is extended or adjusted under 35 U.S.C. 154(b) by 277 days.

(21) Appl. No.: 14/648,335

(22) PCT Filed: Nov. 29, 2013

(86) PCT No.: PCT/EP2013/075166
§ 371 (c)(1),
(2) Date: May 29, 2015

(87) PCT Pub. No.: WO2014/083181
PCT Pub. Date: Jun. 5, 2014

(65) Prior Publication Data

US 2015/0336348 A1 Nov. 26, 2015

(30) Foreign Application Priority Data

Nov. 29, 2012 (EP) ..... 12194856

(51) Int. Cl.
*B31B 1/14* (2006.01)
*B65D 5/18* (2006.01)
(Continued)

(52) U.S. Cl.
CPC ..... *B31B 1/14* (2013.01); *A24F 15/00* (2013.01); *B65D 5/18* (2013.01); *B65D 85/1045* (2013.01);
(Continued)

(58) Field of Classification Search
CPC .. A61K 36/534; A61K 36/752; A61K 9/0014; A61K 2300/00; A61K 9/0019;
(Continued)

(56) References Cited

U.S. PATENT DOCUMENTS 1,988,462 A * 1/1935 Royal ..... B31B 19/00 383/123
2,127,131 A * 8/1938 Moeller ..... B26F 1/44 493/352
(Continued)

FOREIGN PATENT DOCUMENTS

CN 1292338 4/2001
CN 101405191 4/2009
(Continued)

OTHER PUBLICATIONS

PCT Search Report and Written Opinion for PCT/EP2013/075166 dated Apr. 2, 2014 (11 pages).
(Continued)

*Primary Examiner* — Ghassem Alie
(74) *Attorney, Agent, or Firm* — Mueting, Raasch & Gebhardt, P.A.

(57) ABSTRACT

Method for producing a plurality of blanks from a continuous strip of material. Firstly, a continuous strip of material (101) is provided, the strip having a plurality of cut-outs (103) spaced along a longitudinal direction thereof. Then, the continuous strip is cut along a plurality of cut lines (203) to form the plurality of blanks (301), each cut line comprising a straight transverse section and a curved section. Each cut line intersects a respective cut-out in the strip in the curved section of the cut line. Each cut line, together with its respective intersected cut-out, corresponds to an edge (303, 305) of at least one of the plurality of blanks. There is also provided a blank (301) formed by the method and a container (400) for consumer goods, the container comprising
(Continued)

an inner frame (301) formed from a blank formed according by the method.

15 Claims, 2 Drawing Sheets

(51) Int. Cl.
*A24F 15/00* (2006.01)
*B65D 85/10* (2006.01)
*B65D 5/66* (2006.01)
*B31B 50/16* (2017.01)

(52) U.S. Cl.
CPC ..... *B31B 50/16* (2017.08); *B65D 5/662* (2013.01); *B65D 5/6679* (2013.01); *B65D 5/6691* (2013.01); *B65D 2301/10* (2013.01); *Y10T 428/24777* (2015.01)

(58) Field of Classification Search
CPC . B26F 2001/4463; B26D 7/1818; B26D 7/18; B26D 5/662; Y10T 83/9457; Y10T 83/9478; Y10T 83/9473; Y10T 83/2133; Y10T 83/2157; Y10T 83/2107; Y10T 428/24777; B31B 1/14; B31B 2201/145; B31B 50/16; A24F 15/00; B65D 85/1045; B65D 5/6691; B65D 5/18; B65D 5/6679; B65D 2301/10
USPC ..... 83/40, 699.11, 698.11, 698.71, 698.31, 83/116, 128, 142–145, 138–140, 658, 83/659, 669, 670, 123, 126, 673, 346, 83/347
See application file for complete search history.

(56) References Cited

U.S. PATENT DOCUMENTS

| | | | | |
|---|---|---|---|---|
| 3,479,931 | A * | 11/1969 | Bishop | B26F 1/384 493/354 |
| 3,827,322 | A * | 8/1974 | Saunders | B26D 7/1818 83/128 |
| 5,636,559 | A * | 6/1997 | Smithwick, Jr. | B26D 7/1818 493/342 |
| 6,755,300 | B2 | 6/2004 | Brizzi | |
| 7,036,718 | B2 * | 5/2006 | Quaintance | B65D 5/0015 229/109 |
| 8,127,518 | B2 | 3/2012 | Ford | |
| 2007/0017330 | A1 | 1/2007 | Freshwater | |
| 2009/0320660 | A1 | 12/2009 | Gwosdz-Kaupmann | |
| 2011/0006107 | A1 | 1/2011 | Lutzig | |

FOREIGN PATENT DOCUMENTS

| | | |
|---|---|---|
| CN | 101522549 | 9/2009 |
| CN | 102069602 | 5/2011 |
| FR | 2638393 | 5/1990 |
| JP | 2000-43163 | 2/2000 |
| WO | 2011/003926 | 1/2011 |
| WO | 2012/085196 | 6/2012 |

OTHER PUBLICATIONS

European Search Report for Application No. 12194856.6 dated May 13, 2015 (7 pages).
Office Action issued in China for Application No. 201380062042.1 dated Aug. 22, 2016 (17 pages). English translation included.
Office Action issued in Japan for Application No. 2015-544489 dated Jul. 24, 2017 (8 pages). English translation included.

* cited by examiner

METHOD FOR PRODUCING PACKAGING BLANKS FOR CONSUMER GOODS

This application is a U.S. National Stage Application of International Application No. PCT/EP2013/075166, filed Nov. 29, 2013, which was published in English on Jun. 5, 2014 as International Patent Publication WO 2014/083181 A1. International Application No. PCT/EP2013/075166 claims priority to European Application No. 12194856.6 filed Nov. 29, 2012.

The present invention relates to a method for producing a plurality of blanks from a continuous strip of material. In particular, the present invention relates to a method for producing blanks for use in packaging of consumer goods, such as smoking articles.

It is known to package consumer goods such as, for example, elongate smoking articles in containers formed from folded laminar blanks. For example, elongate smoking articles, such as cigarettes and cigars, are commonly sold in hinge lid packs having a box for housing the smoking articles and a lid connected to the box about a hinge line extending across the back wall of the container. An inner frame is often provided within the container. In use, the lid is pivoted about the hinge line to open the pack and so gain access to the smoking articles held within the box.

Such packs are typically constructed from laminar cardboard blanks. For example, inner frame blanks are typically cut from a strip of continuous material provided from a reel or bobbin, using conventional cutting machinery. The inner frames, and other portions of the container, as well as providing structure for the container, may be used to differentiate brands or to provide other information for a consumer. However, providing a number of differently shaped inner frames, or other portions of a container, may slow down the production process due to significant change-over time between one cutting shape and another.

U.S. Pat. No. 1,988,462 describes a method for manufacturing a plurality of bags from a web of material, the web of material comprising a plurality of openings spaced in a longitudinal direction along the web. The web of material is folded and sealed to form a tube and a number of straight transverse cuts are made across the tube to form a plurality of tubular blanks. The bottom end of each blank is then folded and sealed to form a bag.

WO-A-2011/003926 describes a method for producing a plurality of individual inner frames with at least two different shapes from a continuous strip of material. Non-conventional cutting means having a number of differently shaped cutting blades may be used to cut the different shapes of inner frames from the strip of material. Adjacent blanks nest with one another such that a cut-out portion of one inner frame mates with an extension portion of an adjacent inner frame along the continuous strip. The cut-out portions and extension portions may have interlocking shapes, in which case, adjacent inner frames are lifted or lowered relative to one another to separate them.

It would be desirable to provide a method which can produce blanks having new shapes, but using existing high speed cutting machinery.

According to a first aspect of the invention, there is provided a method for producing a plurality of blanks from a continuous strip of material, the method comprising the steps of providing a continuous strip of material having a plurality of cut-outs spaced along a longitudinal direction of the strip and cutting the continuous strip along a plurality of cut lines to form the plurality of blanks, wherein each cut line comprises a straight transverse section and a curved section. According to the invention, the cut lines are spaced along the longitudinal direction of the strip and each cut line intersects a respective cut-out in the strip in the curved section of the cut line, such that each cut line together with its respective intersected cut-out corresponds to an edge of one of the plurality of blanks. Preferably, the cut line together with its respective intersected cut-out corresponds to an edge of two of the plurality of blanks, in particular a trailing edge of a first blank and a leading edge of a subsequent blank, when viewed in the machine direction.

The term "intersects" is used herein to indicate that the cut line passes through or touches the area of the cut-out. For example, where the cut-out has a geometrical shape of a circle, the cut line intersects the cut-out where the cut line is tangential to the cut-out or passes through the area of the cut-out either symmetrically or asymmetrically. In another example, where the cut-out has a geometrical shape of a polyhedron, the cut line intersects the cut-out where the cut line passes through the area of the cut-out, forms an edge of the polyhedron or touches a corner of the polyhedron.

The term "plurality" refers to a number of items that is greater than one, but the exact number of items in the plurality depends on a number of factors. For example, a "plurality of blanks" depends on the length of the strip of material and the length of each blank that is cut from the strip of material. For example, in a reel with length of 10 m and a blank (for example, inner frame) length of 10 cm, the plurality of blanks may refer to 100 blanks. However, where the blanks have a length of only 5 cm the plurality of blanks may refer to 200 blanks for a 10 m reel and 2000 blanks for a 100 m reel.

The method of the invention is advantageous since it may make use of existing conventional high speed cutting machinery to produce a blank having a new shape. The combination of the cut-outs and the cut lines in the continuous strip results in a plurality of blanks having a shape which is different from that of blanks produced by conventional cut lines alone. However, the blanks are nonetheless able to be produced using existing cutting machinery. Moreover, the size of a blank (in the longitudinal direction) may be different from the longitudinal spacing between the conventional cutting lines, simply by selecting an appropriate cut-out shape and size. An additional advantage of the invention is that portions of material adjacent each cut line, which may be adjacent blanks, may be separated from each other after cutting by pulling apart along the longitudinal direction of the strip, that is in the machine direction, irrespective of the shape of the cut-out. No lifting or lowering of the adjacent portions of material is required.

In a preferred embodiment, the continuous strip of material is received with the cut-outs pre-formed therein. Then, the step of cutting the continuous strip along a plurality of cut lines is performed, for example on standard high speed cutting machinery.

Alternatively, the method may further comprise the step of forming the plurality of cut-outs in the continuous strip of material. In that embodiment, the cut-outs are first formed in the continuous strip of material, then the continuous strip of material, including the cut-outs, is cut along the plurality of cut lines. The cut-outs may be formed by any suitable mechanism, for example, using a rotating wheel having several blades attached to the rotating wheel, using a die-cutting tool, or using a laser. The cut-outs may be cut out from the strip of material before winding the strip of material onto a reel for later use in a packaging machine. Alternatively, or in addition, some or all cut-outs may be cut out from the strip of material after winding the strip of material from the reel during use in a packaging machine. Alternatively, or in addition, the separated parts from the strip of material may be also cut after the separation from the strip of material.

In a preferred embodiment, cutting the continuous strip along the plurality of cut lines to form the plurality of blanks is performed without the creation of waste. That is, preferably, each of the plurality of cut lines, with its respective intersected cut-out, corresponds to a first edge of the blank on one side of the cut line and a second edge, opposite the first edge, of the blank on the other side of the cut line. The first edge may be a trailing edge of a first blank. The second edge may be a leading edge of a subsequent blank when viewed in the machine direction. That is, along the portion of the cut line not intersecting the cut-out, the shape of the first edge of one specific blank corresponds to the shape of the second edge of the adjacent blank. The two adjacent blanks mate with each other along the portion of the cut line that does not intersect the cut-out.

Alternatively, each of the plurality of cut lines, with its respective intersected cut-out, may correspond to an edge of only a single blank. In that case, there is a band of unused material between each blank.

The combination of cut line shape, cut-out shape, and cut-out to cut line orientation may be selected such that the edge of the at least one of the plurality of blanks does not comprise an undercut recess. In this specification, the term "undercut recess" is used to indicate a recess in the edge of a blank which is shaped such that, if the recess were to be completely filled with material (which may or may not be part of an adjacent blank), the edge of a convex portion of the material mating with the edge of the recess, it would oppose separation of the blank and the material along the longitudinal direction. An example for an undercut recess is the female part of two mating puzzle pieces.

Alternatively, the method may further comprise the step of selecting a combination of cut line shape, cut-out shape, and cut-out to cut line orientation, such that the edge of the at least one of the plurality of blanks comprises an undercut recess.

If a continuous strip of material without cut-outs were cut along a plurality of cut lines shaped to produce blanks having edges including one or more undercut recesses, adjacent blanks may not be separable along the longitudinal direction of the strip. This would make separation of individual blanks difficult. However, according to the invention, the edge of the at least one of the plurality of blanks may comprise an undercut recess, but adjacent blanks or adjacent portions of material may still be separable along the longitudinal direction of the strip. This is because the edge of a blank comprises a cut line together with its respective intersected cut-out, not only the cut line as in prior art arrangements. The cut line and cut-out may be selected and aligned such that the edge of a blank includes an undercut recess, even though the cut line does not include an undercut recess. Because the cut-outs are formed in the continuous strip of material before the step of cutting the strip along the cut lines, adjacent blanks or adjacent portions of material may be separable along the longitudinal direction of the strip. This makes separation of individual blanks more straightforward.

The method may further comprise, after the step of cutting the continuous strip, the step of separating the blanks in the longitudinal direction of the strip.

The continuous strip may comprise any material suitable for producing the blanks. Suitable materials include, but are not limited to, cardboard, paperboard, plastic, metal, or combinations thereof.

The continuous strip of material may be provided from a reel. The step of cutting the continuous strip along a plurality of cut lines may comprise using a rotating wheel having several blades attached to the rotating wheel, using a die-cutting tool or other suitable means of separation.

The continuous strip of material may have any suitable length, width and thickness. Preferably, the length, width and thickness of the continuous strip of material are suitable for use in conventional cutting machinery. Preferably, the length, width and thickness of the continuous strip of material are suitable to produce blanks having the desired properties.

The cut-outs in the continuous strip of material may have any suitable size and shape. The cut-outs may be the same sizes or different sizes. Preferably, each of the plurality of cut-outs in the continuous strip of material are the same shape. Alternatively, the cut-outs may each be different shapes. The cut-outs may be triangle-shaped or square-shaped. The cut-outs may be shaped such that, when intersected by a cut line, the edge of a resulting blank includes an undercut recess.

The cut-outs may be spaced along the longitudinal direction of the strip at any desired longitudinal spacing. The term "longitudinal spacing" is used to indicate the distance along the strip in the longitudinal direction between adjacent cut-outs or cut lines. The cut-outs may be evenly spaced or unevenly spaced. If the cut-outs are formed using a rotating wheel having several blades attached to the rotating wheel, the longitudinal spacing of the cut-outs may match the spacing between the blades attached to the wheel.

The cut-outs may be positioned at any desired position in the transverse direction of the strip. The cut-outs may each be positioned at the same transverse positions or different transverse positions. The cut-outs may all be cut from the strip of material in a single step, or each cut-out may be cut subsequent to another cut-out. In addition, cut-outs may be overlapping. Advantageously, the tooling for cutting the strip of material may be simplified by cutting a detailed shape by overlaying two subsequent relatively simple cuts. For example, overlaying a triangular cut and a rectangular cut may create a single seven-pointed star shape.

The cut-outs may be positioned at the transverse edge of the continuous strip of material. In that case, the cut-outs are not enclosed by material on at least one side. Alternatively, each of the plurality of cut-outs in the continuous strip of material is fully enclosed by the material. In that case, the cut-outs are positioned away from the transverse edge of the continuous strip. For example, the cut-outs may be positioned at a central position in the transverse direction of the strip.

In one embodiment, the continuous strip of material is provided with an additional plurality of cut-outs spaced along the longitudinal direction of the strip, the additional plurality of cut-outs being spaced from the plurality of cut-outs along a transverse direction of the continuous strip.

In that embodiment, each cut line may intersect a respective additional cut-out in the strip. Thus, each cut line, together with its respective intersected cut-out and intersected additional cut-out, corresponds to an edge of at least one of the plurality of blanks. Alternatively, each cut line may not intersect any of the additional cut-outs. This may be because the additional cut-outs are longitudinally spaced from the cut-outs.

The cut lines preferably each have the same shape. Alternatively, the cut lines may have different shapes. For example, if the step of cutting the continuous strip along a plurality of cut lines comprises using a rotating wheel having several blades attached to the rotating wheel, the cut lines may have different shapes corresponding to different shapes of the blades attached to the rotating wheel. The cut lines are preferably substantially parallel to one another. The cut lines preferably extended generally in the transverse direction of the continuous strip of material. However, the cut lines may also comprise one or more sections with a deeper transverse section bounded by two substantially vertical sections.

In a preferred embodiment, the longitudinal spacing of the plurality of cut lines is the same as the longitudinal spacing of the plurality of cut-outs. In that embodiment, each cut-out in the strip is intersected by a respective cut line.

Alternatively, the longitudinal spacing of the plurality of cut lines may be different from the longitudinal spacing of the plurality of cut-outs. The longitudinal spacing of the plurality of cut lines may be a multiple of the longitudinal spacing of the plurality of cut-outs. For example, the longitudinal spacing of the cut lines may be twice that of the cut-outs, in which case, every second cut-out is intersected by a cut line. For example, the longitudinal spacing of the cut lines may be three times that of the cut-outs, in which case, every third cut-out is intersected by a cut line.

The method may further comprise the step of cutting the continuous strip along an additional plurality of cut lines, wherein the additional cut lines are spaced along the longitudinal direction of the strip. Each additional cut line need not intersect a cut-out in the strip.

According to the first aspect of the invention, there is also provided a method for producing a plurality of substantially identical blanks from a continuous strip of material, the method comprising the steps of: providing a continuous strip of material having a plurality of substantially identical cut-outs spaced along a longitudinal direction of the strip; and cutting the continuous strip along a plurality of substantially identical cut lines to form the plurality of blanks, wherein each cut line comprises a straight transverse section and a curved section; wherein: the cut lines are spaced along the longitudinal direction of the strip at a longitudinal spacing equal to the longitudinal spacing of the cut-outs, each cut line intersects a respective cut-out in the strip in the curved section of the cut line, and each cut line together with its respective intersected cut-out corresponds to an edge of at least one of the plurality of blanks.

The term "blank" used in this specification refers to a piece of material ready to be pressed, folded or otherwise machined into a finished object. Preferably, the blank is a piece of laminar material in the form of a sheet or layer. The blanks produced by the method of the invention are preferably used in packaging for consumer goods. The method may further comprise the step of using the plurality of blanks in packaging for consumer goods. The consumer goods may be smoking articles.

According to a second aspect of the invention, there is provided a blank formed according to the method of the first aspect of the invention.

According to a third aspect of the invention, there is provided a container for consumer goods, the container comprising an inner frame formed from a blank formed according to the method of the first aspect of the invention.

It is known to package consumer goods such as, for example, elongate smoking articles in containers formed from folded laminar blanks. For example, elongate smoking articles, such as cigarettes and cigars, are commonly sold in hinge lid packs having a box for housing the smoking articles and a lid connected to the box about a hinge line extending across the back wall of the container. An inner frame is often provided within the container. The box may comprise a box front wall, a box left side wall, a box right side wall, a box back wall and a box bottom wall. The lid may comprise a lid front wall, a lid left side wall, a lid right side wall, a lid back wall and a lid top wall. The inner frame may comprise an inner frame front wall, an inner frame right side wall and an inner frame left side wall. The front wall of the inner frame may extend above the top of the front wall of the box.

The terms "front", "back", "upper", "lower", "side", "top", "bottom" and other terms used to describe relative positions of the components of containers refer to the container in an upright position with the lid at the top end and the consumer goods accessible from the upper end at the front. The terms "left" and "right" are used with reference to side walls of the container when the container is viewed from the front in its upright position.

The consumer goods within the container may be wrapped in an inner liner. The inner liner and consumer goods together form an inner package. Preferably, the inner frame is mounted between the box and the inner liner. Prior to first opening, the filled container may be wrapped in an outer wrapper.

Where the blanks produced by the method of the invention are used in packaging for consumer goods, particular smoking articles, the blanks may be used as blanks for the container, for the inner frame, for the inner liner or for the outer wrapper. Preferably, however, the blanks produced by the method of the invention are used as blanks for the inner frame. In that case, each cut line together with its respective intersected cut-out corresponds to an edge of one of the plurality of inner frame blanks. The cut lines may be standard cut lines for inner frame laminar blanks. Preferably, the intersection of the cut line and the cut-out is located at an edge of a front wall of the inner frame. When the inner frame is mounted between the box and the inner liner, the intersection of the cut line and the cut-out may be visible to the consumer above the front wall of the box. This may provide the consumer with a new visual impression due to the new shape of inner frame.

The container may take any suitable form for housing consumer goods. For example, as already mentioned, the container may be a hinge-lid container having one or more hinge lids connected to a box housing the consumer goods. Alternatively, the container may be a slide and shell container having an inner slide for housing the consumer goods mounted within an outer shell. Where the container is a slide and shell container, the outer shell or the inner slide may comprise one or more hinge lids. Whatever the form of the container, the method of the invention may be used to produce blanks for any component of the container.

The container, inner frame, inner liner and outer wrapper may be formed from any suitable materials including, but not limited to, cardboard, paperboard, plastic, metal, or combinations thereof. The cardboard may have a weight of between about 100 grams per square meter and about 350 grams per square meter.

The continuous strip, and consequently the blanks, may be printed, embossed, debossed or otherwise embellished with manufacturer or brand logos, trade marks, slogans and other consumer information and indicia.

Containers according to the invention may be in the shape of a rectangular parallelepiped, with right-angled longitudinal and right-angled transverse edges. Alternatively, the container may comprise one or more rounded longitudinal edges, rounded transverse edges, bevelled longitudinal edges or bevelled transverse edges, or combinations thereof. For example, the container according to the invention may comprise, without limitation:

- one or two longitudinal rounded or bevelled edges on the front wall, and/or one or two longitudinal rounded or bevelled edges on the back wall.
- one or two transverse rounded or bevelled edges on the front wall, and/or one or two transverse rounded or bevelled edges on the back wall.
- one longitudinal rounded edge and one longitudinal bevelled edge on the front wall, and/or one transverse rounded edge and one transverse bevelled edge on the back wall.
- one or two transverse rounded or bevelled edges on the front wall and one or two longitudinal rounded or bevelled edges on the front wall.
- two longitudinal rounded or bevelled edges on a first side wall or two transverse rounded or bevelled edges on the second side wall.

Where the container comprises one or more rounded edges, preferably the blanks forming the container comprise three, four, five, six or seven scoring lines or creasing lines to form each rounded edge in the assembled container. The scoring lines or creasing lines may be either on the inside of the container or on the outside of the container. Preferably, the scoring lines or creasing lines are spaced from each other by between about 0.3 mm and 4 mm.

Preferably, the spacing of the creasing lines or scoring lines is a function of the thickness of the laminar blank. Preferably, the spacing between the creasing lines or scoring lines is between about 0.5 and about 4 times larger than the thickness of the laminar blank.

Where the container comprises one or more bevelled edge, preferably the bevelled edge has a width of between about 1 mm and about 10 mm, preferably between about 2 mm and about 6 mm. Alternatively, the container may comprise a double bevel formed by three parallel creasing or scoring lines that are spaced such that two distinct bevels are formed on the edge of the container.

Where the container comprises a bevelled edge, the bevel may be formed by two parallel creasing lines or scoring lines in the laminar blank from which the container is formed. The creasing lines or scoring lines may be arranged symmetrically to the edge between a first wall and a second wall. Alternatively, the creasing lines or scoring lines may be arranged asymmetrically to the edge between the first wall and the second wall, such that the bevel reaches further into the first wall of the container than into the second wall of the container.

Alternatively, the container may have a non-rectangular transversal cross section, for example polygonal such as triangular or hexagonal, or oval, semi-oval, circular or semi-circular.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes.

Through an appropriate choice of the dimensions thereof, containers according to the invention may be designed to hold different total numbers of smoking articles, or different arrangements of smoking articles. For example, through an appropriate choice of the dimensions thereof, containers according to the invention may be designed to hold a total of between ten and thirty smoking articles.

The smoking articles in the container may be arranged in different collations, depending on the total number of smoking articles. For example, the smoking articles may be arranged in a single row of six, seven, eight, nine or ten. Alternatively, the smoking articles may be arranged in two or more rows. The two or more rows may contain the same number of smoking articles. For example, the smoking articles may be arranged in: two rows of five, six, seven, eight, nine or ten; three rows of five or seven; or four rows of four, five or six. Alternatively, the two or more rows may include at least two rows containing different number of smoking articles to each other. For example, the smoking articles may be arranged in: a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7).

Containers according to the present invention may hold smoking articles of the same type or brand, or of different types or brands. In addition, both filterless smoking articles and smoking articles with various filter tips may be contained, as well as smoking articles of differing length (for example, between about 40 mm and about 180 mm), diameter (for example, between about 4 mm and about 9 mm). In addition, the smoking articles may differ in strength of taste, resistance to draw and total particulate matter delivery. Preferably, the dimensions of the container are adapted to the length of the smoking articles, and the collation of the smoking articles. Typically, the outer dimensions of the container are between about 0.5 mm to about 5 mm larger than the dimensions of the bundle or bundles of smoking articles housed inside the container.

The length, width and depth of containers according to the invention may be such that, in the closed position, the resultant overall dimensions of the container are similar to the dimensions of a typical disposable hinge-lid pack of twenty cigarettes.

Preferably, containers according to the invention have a height of between about 60 mm and about 150 mm, more preferably a height of between about 70 mm and about 125 mm, wherein the height is measured from the top wall to the bottom wall of the container.

Preferably, containers according to the invention have a width of between about 12 mm and about 150 mm, more preferably a width of between about 70 mm and about 125 mm, wherein the width is measured from one side wall to the other side wall of the container.

Preferably, containers according to the invention have a depth of between about 6 mm and about 100 mm, more preferably a depth of between about 12 mm and about 25 mm wherein the depth is measured from the front wall to the back wall of the container (comprising the hinge between box and lid).

Preferably, the ratio of the height of the container to the depth of the container is in between about 0.3 to 1 and about 10 to 1, more preferably between about 2 to 1 and about 8 to 1, most preferably between about 3 to 1 and 5 to 1.

Preferably, the ratio of the width of the container to the depth of the container is in between about 0.3 to 1 and about 10 to 1, more preferably between about 2 to 1 and about 8 to 1, most preferably between about 2 to 1 and 3 to 1.

As well as housing a bundle of smoking articles, the container may further comprise other consumer goods, for example matches, lighters, extinguishing means, breath-fresheners or electronics. The other consumer goods may be attached to the outside of the container, contained within the container along with the smoking articles, in a separate compartment of the container or combinations thereof.

According to the first aspect of the invention, there is also provided a method for producing a plurality of substantially identical blanks from a continuous strip of material, the blanks for use as inner frame blanks for packaging for smoking articles, the method comprising the steps of: providing a continuous strip of inner frame material having a plurality of substantially identical cut-outs spaced along a longitudinal direction of the strip; and cutting the continuous strip along a plurality of substantially identical cut lines to form the plurality of inner frame blanks; wherein: the cut lines are spaced along the longitudinal direction of the strip at a longitudinal spacing equal to the longitudinal spacing of the cut-outs, each cut line intersects a respective cut-out in the strip, and each cut line together with its respective intersected cut-out corresponds to an edge of at least one of the plurality of inner frame blanks. Preferably, each cut line comprises a straight transverse section and a curved section, wherein each cut line intersects its respective cut-out in the strip in the curved section of the cut line. Preferably, the edge of the inner frame blank is an edge which is visible to the consumer when the inner frame is mounted within the box. The edge may comprise the upper edge of the inner frame front wall. The edge may comprise a cut-away portion facilitating access to the consumer goods in the container.

According to a fourth aspect of the invention, there is provided a continuous strip of material for forming a plurality blanks for use in packaging for consumer goods, wherein the continuous strip of material comprises a plurality of cut-outs spaced along a longitudinal direction of the strip.

In one embodiment, each of the plurality of cut-outs in the continuous strip of material are the same shape.

The continuous strip of material may further comprise an additional plurality of cut-outs spaced along the longitudinal direction of the strip, the additional plurality of cut-outs being spaced from the plurality of cut-outs along a transverse direction of the continuous strip.

Features described in relation to one aspect of the invention may also be applicable to another aspect of the invention.

The invention will be further described, by way of example only, with reference to the accompanying drawings in which.

Figure 1:
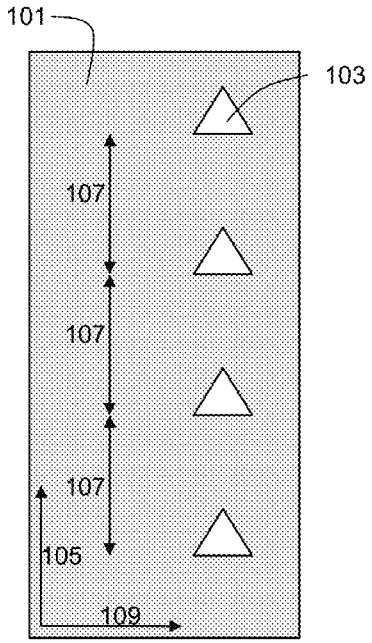
FIG. 1 shows a first example of a continuous strip of material having a plurality of cut-outs spaced along a longitudinal direction of the strip.

FIG. 1 shows a first example of a continuous strip of material 101. In this embodiment, the material may be any material suitable for producing inner frame blanks for packaging for smoking articles. The continuous strip of material 101 includes a plurality of triangular cut-outs 103 spaced along the longitudinal direction 105 of the strip. In this embodiment, the triangular cut-outs 103 are evenly spaced along the longitudinal direction, with a spacing 107. The triangular cut-outs 103 are also aligned with each other in the transverse direction 109 of the strip.

Figure 2:
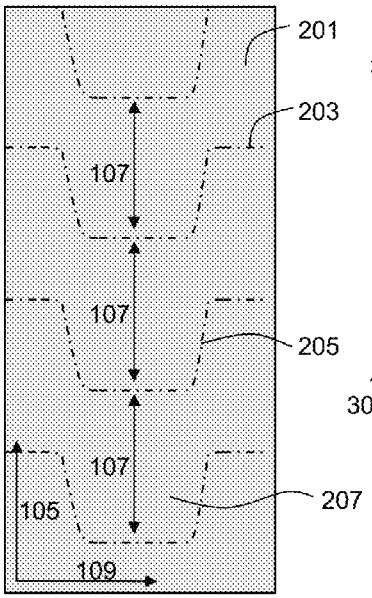
FIG. 2 shows a step of cutting a continuous strip of material along a plurality of cut lines.

FIG. 2 schematically shows cutting a continuous strip of material along a plurality of cut lines. In FIG. 2, the continuous strip of material 201 may be a conventional strip of material, and does not include cut-outs like the continuous strip of material 101 illustrated in FIG. 1. The continuous strip of material 201 is cut along a plurality of cut lines 203, for example, using conventional cutting machinery. In this embodiment, the cut lines 203 are evenly spaced along the longitudinal direction 105 of the strip, with a spacing 107 equal to the spacing of the cut-outs 103 in the strip of material 101 illustrated in FIG. 1. The cut lines 203 are suitably shaped to produce blanks for inner frames for packaging for smoking articles, as will be explained with reference to FIGS. 3 and 4.

The cut lines 203 in FIG. 2 produce a nested arrangement of blanks along the continuous strip of material 201. That is, a first edge of a particular blank corresponds to a second edge, opposite the first edge, of an adjacent blank. Two adjacent blanks mate with each other along each cut line 203. In this embodiment, each blank includes a cut-away portion 205 and an extension portion 207. The cut-away portion 205 provides easy access to the smoking articles when the inner frame is assembled in the container for smoking articles.

Figure 3:
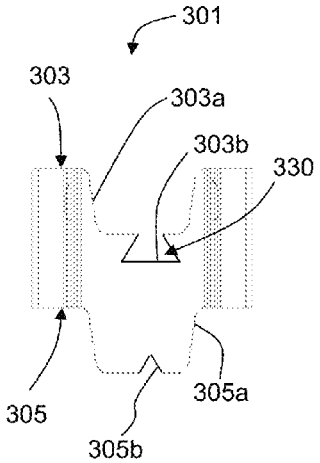
FIG. 3 shows a blank for an inner frame for packaging for smoking articles according to a first embodiment of the invention.

FIG. 3 shows a blank 301 for an inner frame for packaging for smoking articles produced using the continuous strip of material 101 of FIG. 1, cut according to the cutting step shown in FIG. 2. The continuous strip of material 101 has been aligned with the cut lines 203 such that each cut line 203 intersects a respective cut-out 103. Since the longitudinal spacing of the cut-outs 103 is equal to the longitudinal spacing of the cut lines 203, every cut-out 103 is intersected by a cut line 203.

The inner frame blank 301 has an upper edge 303 and a lower edge 305. The upper edge 303 of the blank 301 comprises a) the portion of a cut line 203 not intersecting a cut-out 103 (shown as edge portion 303*a* in FIG. 3) and b) where the cut line 203 intersects the cut-out 103, part of the edge of cut-out 103 itself (shown as 303*b* in FIG. 3), forming an undercut recess 330. Since cut lines 203 produce a nested arrangement of blanks, along edge portion 303*a*, the upper edge 303 of the blank 301 is also the lower edge of an adjacent blank (not shown). Similarly, the lower edge 305 of the blank 301 comprises a) the portion of a cut line 203 not intersecting a cut-out 103 (shown as 305*a* in FIG. 3) and b) where the cut line 203 intersects the cut-out 103, part of the edge of the cut-out 103 itself (shown as 305*b* in FIG. 3). Along edge portion 305*a*, the lower edge 305 of the blank 301 is also the upper edge of an adjacent blank (not shown). In this embodiment, the cut-outs 103 are intersected by cut lines 203 at the cut-away portions 205 and extension portions 207.

Figure 4:
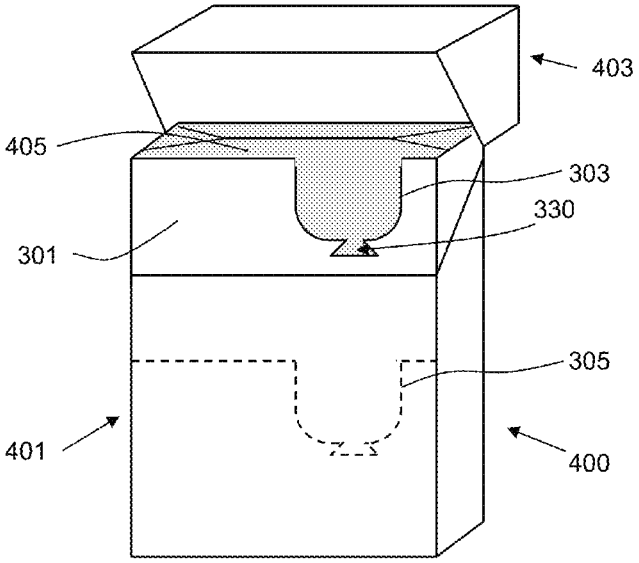
FIG. 4 shows a container for smoking articles incorporating the inner frame blank of FIG. 3.

FIG. 4 shows a container for smoking articles incorporating the inner frame blank of FIG. 3. FIG. 4 shows a hinge lid container 400 having the form of a rectangular parallelepiped comprising a box 401, a lid 403 and inner frame 301. The inner frame 301 is of the form illustrated in FIG. 3 and has been produced using the continuous strip of material 101 of FIG. 1, cut according to the cutting step shown in FIG. 2, then folded for incorporation into container 400. A wrapped bundle of smoking articles 405 is arranged within the container 400. The inner frame 301 is mounted between the box 401 and the bundle 405 of smoking articles.

As already discussed in relation to FIG. 3, inner frame 301 comprises an upper edge 303 and a lower edge 305. The upper edge 303 is visible above the front wall of the box 401 when the lid 403 is open. Because a cut-out 103 is intersected by a cut line 203 at the cut-away portion 205, the cut-away portion 205 of the upper edge 303 of the front wall of the inner frame 301 has a new shape and provides a new visual impression on a consumer. Nevertheless, the inner frame 301 may be manufactured using conventional cutting steps (for example, as shown in FIG. 2). The lower edge 305 is inside the box 401, so is not visible to a consumer and is shown with a dashed line in FIG. 4.

Figure 5:
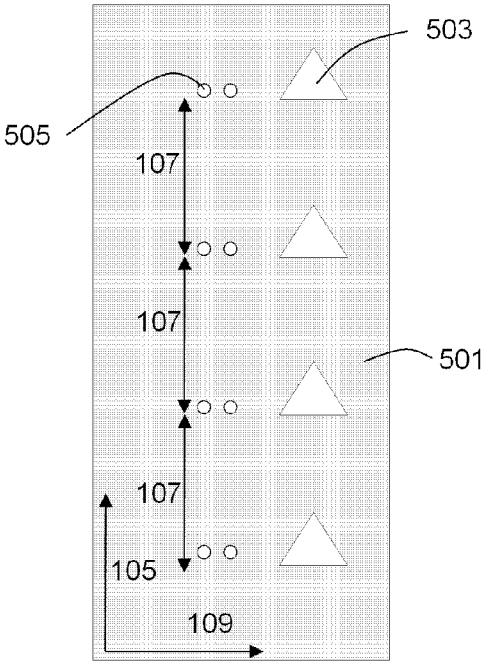
FIG. 5 shows a second example of a continuous strip of material having a plurality of cut-outs spaced along a longitudinal direction of the strip.

FIG. 5 shows a second example of a continuous strip of material 501. As in FIG. 1, the material may be any material suitable for producing inner frame blanks for packaging for smoking articles. The continuous strip of material 501 includes a plurality of triangular cut-outs 503 spaced along the longitudinal direction 105 of the strip. As in FIG. 1, the triangular cut-outs 503 are evenly spaced along the longitudinal direction, with a spacing 107, and are aligned with one another in the transverse direction 109. In FIG. 5, the continuous strip of material 501 further includes a plurality of circular cut-outs 505 spaced from cut-outs 503 in the transverse direction 109. The circular cut-outs 505 are also spaced along the longitudinal direction 105 of the strip. In FIG. 5, the circular cut-outs 505 are evenly spaced along the longitudinal direction, with the same spacing 107 as the triangular cut-outs 503.

Figure 6:
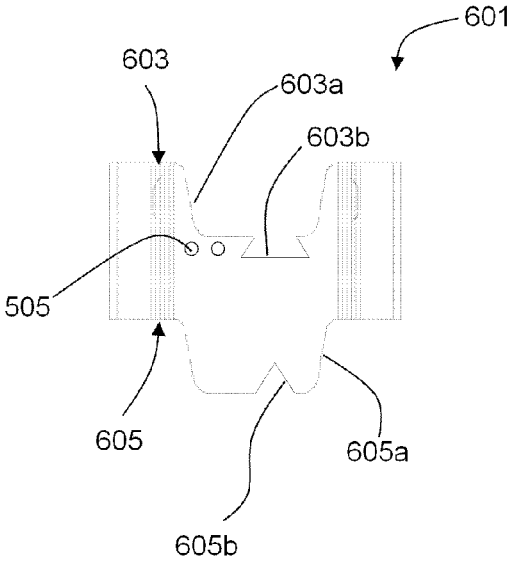
FIG. 6 shows a blank for an inner frame for packaging for smoking articles according to a second embodiment of the invention.

FIG. 6 shows a blank 601 for an inner frame for packaging for smoking articles produced using the continuous strip of material 501 of FIG. 5, cut according to the cutting step shown in FIG. 2. The continuous strip of material 501 has been aligned with the cut lines 203 such that each cut line 203 intersects a respective cut-out 503 but does not intersect cut-outs 505. Since the longitudinal spacing of the cut-outs 503 is equal to the longitudinal spacing of the cut lines 203, every cut-out 503 is intersected by a cut line 203. Since the longitudinal spacing the cut-outs 505 is also equal to the longitudinal spacing of the cut lines 203, cut-outs 505 are produced on every blank 601.

As in FIG. 3, the inner frame blank 601 has an upper edge 603 and a lower edge 605. The upper edge 603 of the blank 601 comprises a) the portion of a cut line 203 not intersecting a cut-out 503 (shown as edge portion 603*a* in FIG. 6) and b) where the cut line 203 intersects the cut-out 503, part of the edge of cut-out 503 itself (shown as 603*b* in FIG. 6). Since cut lines 203 produce a nested arrangement of blanks, along edge portion 603*a*, the upper edge 603 of the blank 601 is also the lower edge of an adjacent blank (not shown). Similarly, the lower edge 605 of the blank 601 comprises a) the portion of a cut line 203 not intersecting a cut-out 503 (shown as 605*a* in FIG. 6) and b) where the cut line 203 intersects the cut-out 503, part of the edge of the cut-out 503 itself (shown as 605*b* in FIG. 6). Along edge portion 605*a*, the lower edge 605 of the blank 601 is also the upper edge of an adjacent blank (not shown). As in FIG. 3, the cut-outs 503 are intersected by cut lines 203 at the cut-away portions 205 and extension portions 207.

Inner frame blank 601 also includes cut-outs 505. Since the continuous strip of material 501 has been aligned with the cut lines 203 such that each cut line 203 does not intersect cut-outs 505, the cut-outs 505 do not form part of either the upper edge 603 or the lower edge 605 of the blank 601. The cut-outs 505 are adjacent the cut-away portions 205.

Figure 7:
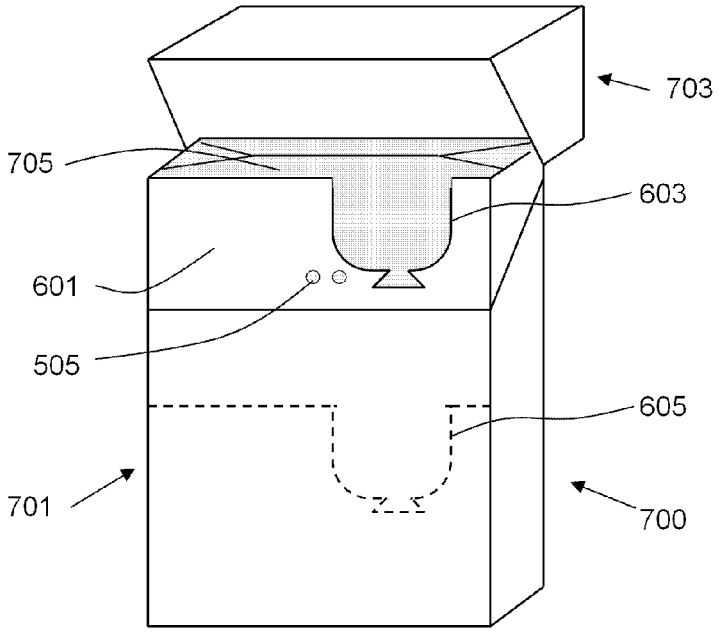
FIG. 7 shows a container for smoking articles incorporating the inner frame blank of FIG. 6.

FIG. 7 shows a container for smoking articles incorporating the inner frame blank of FIG. 6. FIG. 7 shows a hinge lid container 700 having the form of a rectangular parallelepiped comprising a box 701, a lid 703 and inner frame 601. The inner frame 601 is of the form illustrated in FIG. 6 and has been produced using the continuous strip of material 501 of FIG. 5, cut according to the cutting step shown in FIG. 2, then folded for incorporation into container 700. A wrapped bundle of smoking articles 705 is arranged within the container 700. The inner frame 601 is mounted between the box 701 and the bundle 705 of smoking articles.

As already discussed in relation to FIG. 6, inner frame 601 comprises an upper edge 603 and a lower edge 605. The upper edge 603 is visible above the front wall of the box 701 when the lid 703 is open. Because a cut-out 503 is intersected by a cut line 203 at the cut-away portion 205, the cut-away portion 205 of the upper edge 603 of the front wall of the inner frame 601 has a new shape and provides a new visual impression on a consumer. In addition, the cut-outs 505 which are adjacent the cut-away portion 205 of the front wall of the inner frame 601 also produce a new visual impression on a consumer. The wrapped bundle 705 of smoking articles may be visible through cut-outs 505. The inner frame 601 may be manufactured using conventional cutting steps (for example, as shown in FIG. 2). The lower edge 605 is inside the box 701, so is not visible to a consumer and is shown with a dashed line in FIG. 7.

The invention claimed is:

1. A method for producing a plurality of blanks from a continuous strip of material, the method comprising the steps of:

providing a continuous strip of material having a plurality of cut-outs spaced along a longitudinal direction of the strip;

cutting the continuous strip along a plurality of cut lines to form the plurality of blanks, wherein each cut line comprises a straight transverse section and a curved section, wherein the cut lines are spaced along the longitudinal direction of the strip, each cut line intersects a respective cut-out in the strip in the curved section of the cut line, and each cut line together with its respective intersected cut-out corresponds to an edge of one of the plurality of blanks; and selecting a combination of cut line shape, cut-out shape, and cut-out to cut line orientation, such that the edge of the at least one of the plurality of blanks comprises an undercut recess, wherein the curved section of each cut line cuts a portion of the respective cut-out, and wherein a remaining portion of the respective cut-out defines the undercut recess.

2. A method according to claim 1, further comprising the step of forming the plurality of cut-outs in the continuous strip of material.

3. A method according to claim 2, wherein each of the plurality of cut lines, with its respective intersected cut-out, corresponds to a first edge of the blank on one side of the cut line and a second edge, opposite the first edge, of the blank on the other side of the cut line.

4. A method according to claim 3, further comprising, after the step of cutting the continuous strip, the step of separating the blanks in the longitudinal direction of the strip.

5. A method according to claim 4, wherein each of the plurality of cut-outs in the continuous strip of material is fully enclosed by the material.

6. A method according to claim 5, wherein the continuous strip of material is provided with an additional plurality of cut-outs spaced along the longitudinal direction of the strip, the additional plurality of cut-outs being spaced from the plurality of cut-outs along a transverse direction of the continuous strip.

7. A method according to claim 1, wherein each of the plurality of cut lines, with its respective intersected cut-out, corresponds to a first edge of the blank on one side of the cut line and a second edge, opposite the first edge, of the blank on the other side of the cut line.

8. A method according to claim 1, further comprising, after the step of cutting the continuous strip, the step of separating the blanks in the longitudinal direction of the strip.

9. A method according to claim 1, wherein each of the plurality of cut-outs in the continuous strip of material are the same shape.

10. A method according to claim 1, wherein each of the plurality of cut-outs in the continuous strip of material is fully enclosed by the material.

11. A method according to claim 1, wherein the continuous strip of material is provided with an additional plurality of cut-outs spaced along the longitudinal direction of the strip, the additional plurality of cut-outs being spaced from the plurality of cut-outs along a transverse direction of the continuous strip.

12. A method according to claim 1, wherein the longitudinal spacing of the plurality of cut lines is the same as the longitudinal spacing of the plurality of cut-outs.

13. A method according to claim 1, further comprising the step of using the plurality of blanks in packaging for consumer goods.

14. A blank formed according to the method of claim 1.

15. A container for consumer goods, the container comprising an inner frame formed from a blank formed according to claim 14.

* * * * *